US005516175A

United States Patent [19]

Christensen

[11] Patent Number: 5,516,175

[45] Date of Patent: May 14, 1996

[54] BAG CARRIER AND A METHOD OF MAKING THE SAME

[76] Inventor: Arthur E. Christensen, 1316 Dulaney Valley Rd., Towson, Md. 21286

[21] Appl. No.: 311,248

[22] Filed: Sep. 23, 1994

[51] Int. Cl.[6] ..... B65D 33/06

[52] U.S. Cl. ..... 294/137; 294/158

[58] Field of Search ..... 294/137, 158, 294/170, 171; 383/13, 25; 16/110 R, 114 R, DIG. 12, DIG. 19, DIG. 24

[56] References Cited

U.S. PATENT DOCUMENTS

| | | | |
|---|---|---|---|
| 743,945 | 11/1903 | Soden | 294/171 |
| 2,105,119 | 1/1938 | Hindes | 16/DIG. 24 |
| 2,457,858 | 1/1949 | Alexander | 294/170 X |
| 3,232,355 | 2/1966 | Woolworth | 16/DIG. 24 |
| 3,752,525 | 8/1973 | Hanna et al. | 294/137 X |
| 4,666,203 | 3/1987 | Castro . | |
| 4,729,271 | 3/1988 | Kensigson | 16/DIG. 12 |
| 4,991,894 | 2/1991 | Rutens . | |
| 5,364,148 | 11/1994 | Bartocci | 294/171 |

FOREIGN PATENT DOCUMENTS

| | | | |
|---|---|---|---|
| 722397 | 3/1932 | France | 294/137 |
| 2258 | of 1884 | United Kingdom | 294/137 |
| 16085 | of 1915 | United Kingdom | 294/171 |

*Primary Examiner*—Dean Kramer

*Attorney, Agent, or Firm*—Seidel Gonda Lavorgna & Monaco

[57] ABSTRACT

A bag carrier useful for transporting at least one bag which includes a loop handle. The carrier includes a shaft for supporting the loop handle when the handle is disposed about the shaft, and at least one handle member disposed on and co-axial with the shaft. The handle may be formed integral with the shaft or may be attached thereto such as through the use of adhesive or by press-fitting the handles onto the shaft. The handles are made from compressible material, such as foam, which functions to minimize the discomfort associated with carrying the bags. The bag carrier may be manufactured by first forming the shaft with the desired cross-section. At least one handle is then formed with an outer cross-sectional dimension larger than that of the shaft. The handle is slid over the shaft to complete the carrier. A coating may be applied to the handle or the shaft to operate as a means for identifying or advertising. The handles may be configured in a shape which will further assist in advertising.

12 Claims, 3 Drawing Sheets

BAG CARRIER AND A METHOD OF MAKING THE SAME

FIELD OF THE INVENTION

The present invention relates to a hand-held apparatus for carrying bags and, more particularly, to a bag carrier which provides cushioning to the hand to minimize the discomfort associated with transporting heavy bags with narrow handles.

BACKGROUND OF THE INVENTION

There has been an increased use of plastic grocery bags and shopping bags which have very narrow handles. In fact, the handles may be no more than two narrow straps of the bag material. Such handles make it possible to carry several bags in one hand by concentrating the entire weight of the bag along the narrow strip of material. However, this concentrated load is then transferred to a correspondingly narrow area of the hand carrying the bag, which soon leads to considerable discomfort.

Attempts have been made to alleviate problems associated with transporting loaded bags. One such attempt is depicted in U.S. Pat. No. 4,666,203, entitled BAG CARRIER, which discloses a bag carrier configuration that incorporates two hooks at either end to hold the bag handles. Flexible straps are used to restrain the handles on the hooks.

U.S. Pat. No. 4,991,894 discloses a C-shaped carrier member, wherein the legs of the "C" support the bag handles. However, the bag carrier does not provide any sort of cushioning to reduce hand discomfort associated with carrying the bags.

A need therefore exists for a bag carrier which provides a comfortable grip for carrying heavy bags with narrow handles, and which can be manufactured in an inexpensive manner. Since an inexpensive carrier is likely to be discarded after use, it would be a further advantage to have a carrier design which can be adapted as a visual advertising piece, such that it can be distributed at a subsidized low cost or as a free attachment to retail products in the grocery or bottle stores where such plastic bags are commonly used.

SUMMARY OF THE INVENTION

An object of the present invention is to provide a bag carrier for minimizing the discomfort associated with the transporting of a bag which has a narrow handle.

Another object of the present invention is to provide a method for making a bag carrier for supporting and transporting a bag which has a narrow handle.

These and other objects are achieved through the bag carrier of the present invention useful for transporting at least one bag which includes a loop handle. The carrier includes a shaft for supporting the loop handle when the handle is disposed about the shaft, and at least one handle member disposed on and co-axial with the shaft. The handle may be formed integral with the shaft or may be attached thereto such as through the use of adhesive or by press-fitting the handles onto the shaft. In the preferred embodiment, two handles are disposed on opposite ends of the shaft and are cylindrical in shape. The handles are made from compressible material, such as foam, which functions to minimize the discomfort associated with carrying the bags. The shaft may be formed from wood, metal or plastic so as to minimize the cost associated with manufacturing the carrier.

The bag carrier may be manufactured by first forming the shaft with the desired cross-section. At least one handle is then formed with an outer cross-sectional dimension larger than that of the shaft. The handle is slid over the shaft to complete the carrier.

A coating may be applied to the handle and the shaft to operate as a means for identifying or advertising. The handles may be configured in a shape which will further assist in advertising.

The foregoing and other objects, features and advantages of the present invention will become more apparent in light of the following detailed description of exemplary embodiments thereof, as illustrated in the accompanying drawings.

BRIEF DESCRIPTION OF THE DRAWINGS

For the purpose of illustrating the invention, the drawings show several embodiments of the invention; it being understood, however, that this invention is not limited to the precise arrangements and instrumentalities shown.

DETAILED DESCRIPTION OF THE PREFERRED EMBODIMENTS

Figure 1:
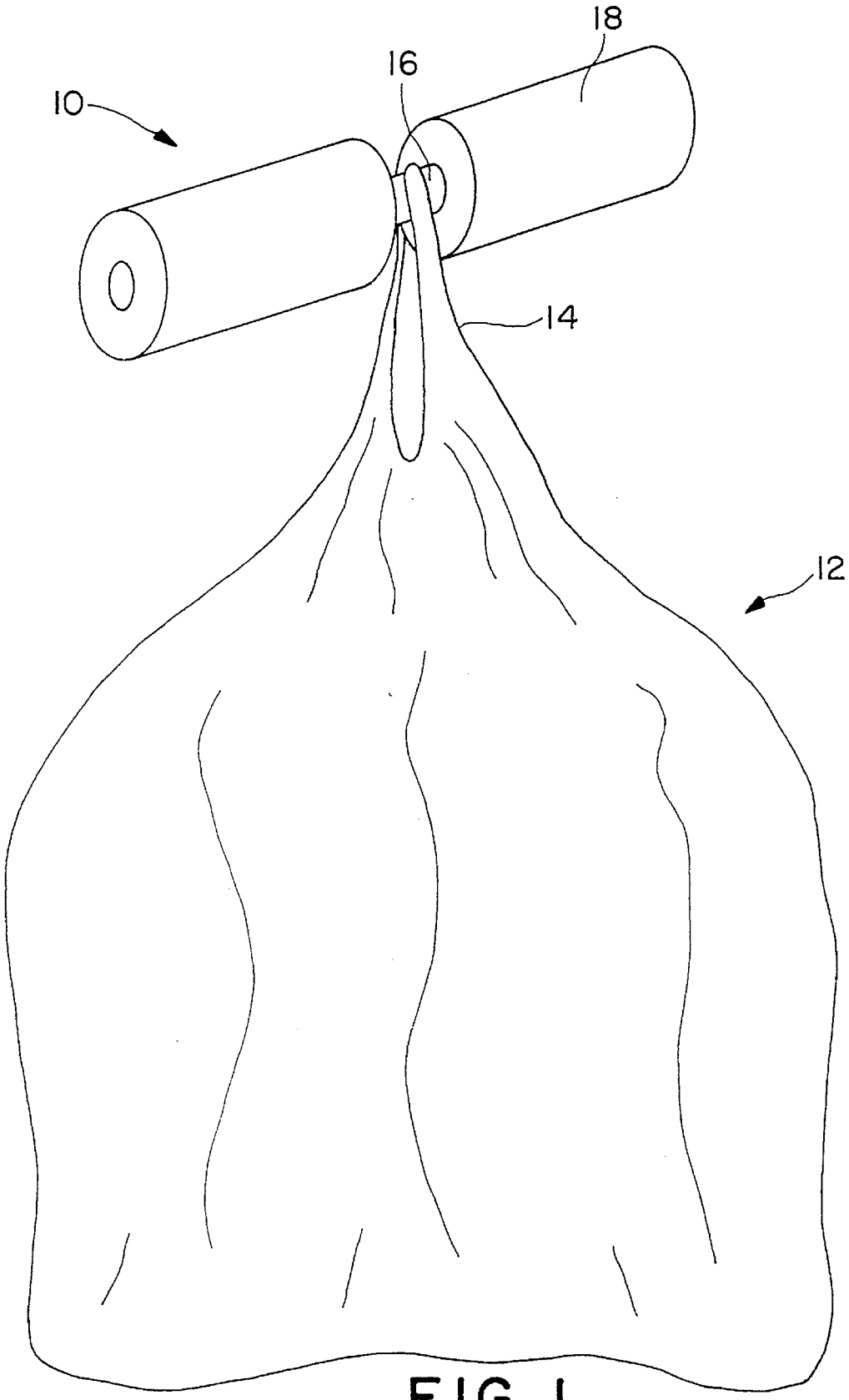
FIG. 1 is an isometric view of one embodiment of a bag carrier, according to the present invention, in use supporting a bag.

Referring now to the drawings, wherein like reference numerals illustrate corresponding or similar elements, FIG. 1 shows a bag carrier 10 supporting a grocery bag 12 filled with heavy items such as cans or bottles. The bag 12 has at least one loop handle 14. The most common of such bags are made of thin plastic material and have two integral plastic straps which serve as the handle.

Reference is also made to Disclosure Document No. 320226 filed on Nov. 4, 1992 which relates to the present invention and is incorporated herein by reference.

When such bags are hand-carried, the plastic straps are usually held together along four curled fingers, in the area between or in the first or second phalangeal articulations. If more than one bag is carried, the handle of each bag may be looped over only one or two fingers. The straps may also twist and stretch into a very narrow cords under the height of the bag. Thus, the weight is supported by a small area of the hand, and soon causes fatigue and discomfort. By contrast, the bag carrier 10 distributes the load over a greater area and through a cushioned material, as described hereafter.

The bag carrier 10 is configured with a circular cross-section and an overall size that can be comfortably held within the curled fingers. The bag carrier 10 includes a shaft 16 disposed between and within opposed handle members 18. The narrow loop handle 14 transfers the bag's weight onto the shaft 16, which in turn distributes the weight through the handle members 18, thus spreading the load over a larger area of the hand and through a cushioned material.

Figure 2:
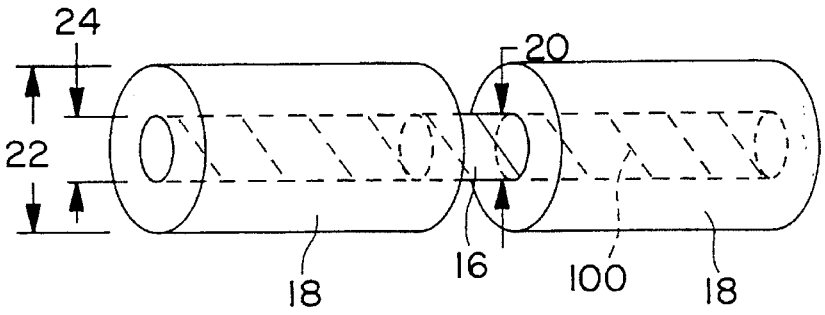
FIG. 2 is an isometric view of one embodiment of bag carrier according to the present invention.

Referring now to FIG. 2, the shaft 16 is disposed within the two handle members 18, which are positioned at opposite ends of the shaft 16. The shaft 16 is preferably a cylindrical wooden dowel, to reduce cost and to facilitate assembly as will be discussed hereinafter. The cross-sectional diameter of the shaft 16 represents a first shaft dimension 20, and is chosen depending upon the weight the shaft is likely to carry and the properties of the shaft material. In this embodiment, the shaft 16 is approximately ⅜ inches in diameter.

The two handle members 18 are positioned apart from one another on the shaft 16 to permit the loop handle 14 to rest directly on the shaft 16. In order to disperse the load over a wider area, each handle member 18 is configured with a first handle dimension 22, representing the cross-section of the handle 18, which is larger than the first shaft dimension 20. Consequently, the increased dimension results in a larger area over which to transfer the loads. In the preferred embodiment, the handle members 18 are cylindrical in shape, and the shaft and handle member's first dimensions are their respective cross-sectional diameters. It should be noted that the handle members 18 may be configured in other shapes without detracting from the invention.

Figure 3:
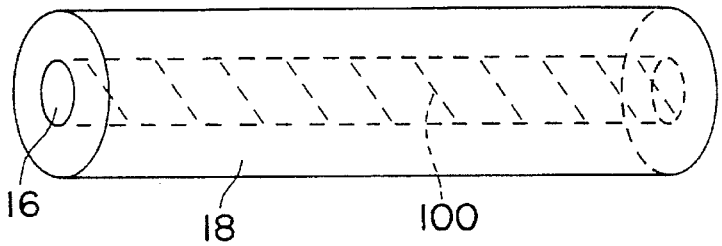
FIG. 3 is an isometric view of a second embodiment of bag carrier according to the present invention.

In an alternate embodiment, shown in FIG. 3, the handle member 18 is a single element disposed about the shaft 16 and may extend along the entire length of the shaft. As can be seen from the figure, the first handle dimension 22 (diameter) is, logically, larger than the first shaft dimension 20 (shaft diameter). In use, the loop handle 14 is placed over the handle member 18 and positioned approximately in the center of the handle member 18. The load from the bag 12 will be supported by the handle member 18 and the shaft 16.

The handle member 18 may be manufactured as a separate component from the shaft 16 and subsequently mounted to the shaft 16 to form the bag carrier 10. In order to minimize the discomfort to the person holding the bag carrier, it is preferable to manufacture the handle member 18 from a resilient material which is highly compressible. The compressibility of the material will permit the handle member 18 to deform to the contours of the person's hand. In the preferred embodiment, the handle member 18 is manufactured from a foam material, such as polyethylene or vinyl.

The handle member 18 may be attached to the shaft 16 through a variety of methods, such as a suitable adhesive. Alternately, the handle member 18 may be press-fit onto the shaft 16. In order to press-fit the handle member 18 onto the shaft 16, a second handle dimension 24, which represents the dimension of the aperture into which the shaft 16 is disposed, must be configured to form a relatively tight fit between the shaft 16 and the handle member 18, i.e., the second handle dimension 24 should be less than or equal to the first shaft dimension 20. The press-fit would prevent the handle member 18 from readily sliding off the shaft 16. In the preferred embodiment, the handle members 18 are made from a compressible foam material, with a second handle dimension 24 sized smaller than the first shaft dimension 20 of the shaft 16. The deformability of the foam material permits that handle members 18 to slide over the shaft 16, thereby providing a relatively secure attachment.

To prevent the inadvertent twisting of handle members 18 when mounted on the shaft 16, the shaft may be configured in a shape other than cylindrical. For example, if the shaft 16 is formed with a rectangular cross-section, the corners of the rectangular cross-section would restrain the handle member 18 from twisting. Alternatively, the shaft 16 may be formed with ridges or grooves 100 which will increase the coefficient of friction between the shaft 16 and the handle member 18.

Figure 4:
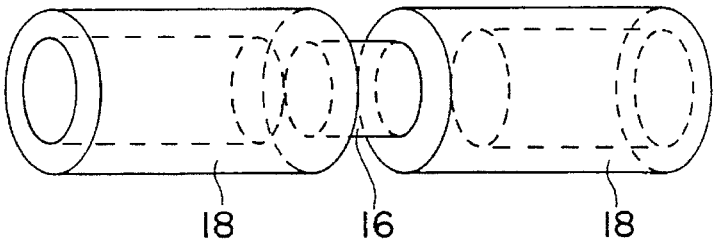
FIG. 4 is an isometric view of a third embodiment of bag carrier according to the present invention.
Figure 5:
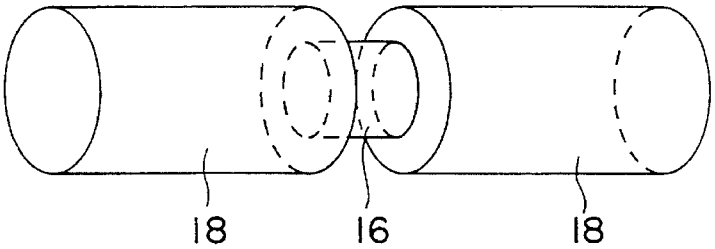
FIG. 5 is an isometric view of a fourth embodiment of bag carrier according to the present invention.

Referring now to FIG. 4, an alternate embodiment is illustrated wherein the handle member 18 is integral with the shaft 16. In the preferred embodiment, a plastic molding process is used to form the handle member 18 and the member 16. The handle member 18 may be partially hollow with a sufficient amount of material remaining in the vicinity of the shaft 16 to provide a rigid connection and to minimize the weight and to reduce the stiffness. However, if stiffness and weight are not a concern, the handle member 18 may be formed as a solid piece as shown in FIG. 5.

Another embodiment, not depicted, would incorporate external threads on the shaft 16 and internal threads on the handle members 18. The internal threads of the handle members 18 may then be engaged with the external threads on the shaft 16, thereby forming the bag carrier 10.

Figure 6:
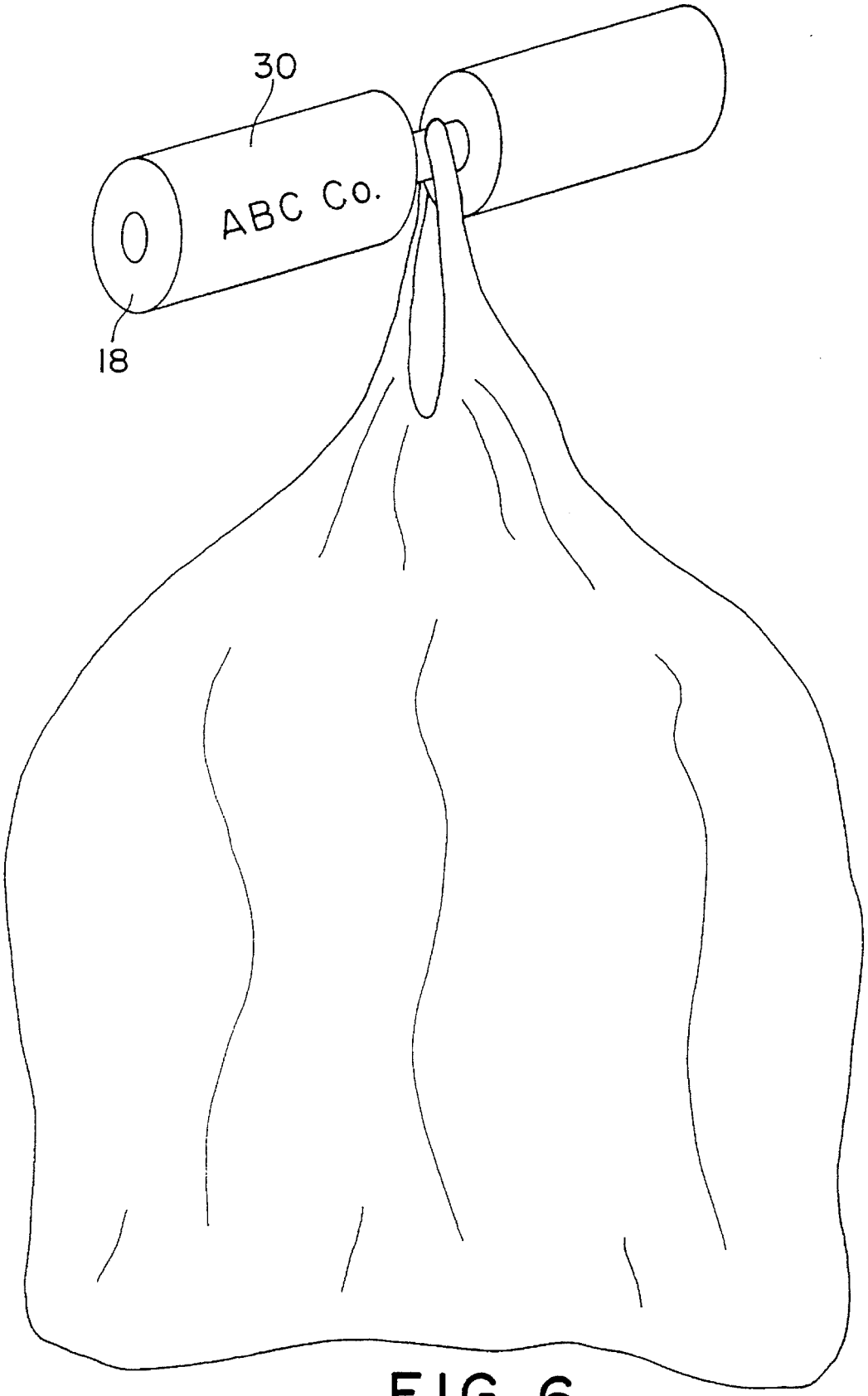
FIG. 6 is an isometric view of another embodiment of bag carrier, according to the present invention, in use supporting a bag.

Referring now to FIG. 6, a paint or other coating 30 may be disposed on the external surface of the handle member 18 and shaft 16. The coating 30 may operate as a means of identification or advertising (e.g, name of a product or an advertisement for a particular company). Furthermore, the handle member 18 itself may be formed in a shape that aids in identifying the particular entity. For example, the shape of the handle member 18 may be configured to replicate an aluminum beverage can with the coating 30 duplicating of the trade dress colors and designs associated with the particular beverage manufacturer.

The presently preferred embodiment of the bag carrier 10, comprises a shaft and two handle members 18 formed from polyethylene foam. The bag carrier is manufactured by first providing a shaft 16. In the preferred embodiment, the shaft 16 is a wood dowel, and has a length of 3.5 inches and a first shaft dimension (diameter) of ⅜inches. To facilitate sliding the handle members 18 onto the shaft 16, the ends of the dowel are beveled. To further aid in sliding the handle members 18 onto the shaft 16, a helical groove may be formed in the dowel to reduce the coefficient of friction when the handle member is twisted and slid onto the shaft 16 in the direction of the helix.

The handle members 18 may be formed by a suitable molding process for polyethylene foam. The handle members 18 may be formed as solid elements and, later turned on a lathe to form the second handle dimension 24. Alternately, the mold may be configured to produce a handle member 18 with a bore already formed therethrough. A paint coating 30 for advertisement may then be applied to the handle member 18.

The bag carrier 10 is completed by sliding the handle members 18 onto the shaft 16. If an adhesive is used, it may be applied either to the shaft member 16 or to the handle member 18. If a press-fit is utilized, the handle member 18 is forced onto the shaft 16, resulting in the local deformation of the handle member 18 where it impacts the shaft 16.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed is:

1. A bag carrier for transporting at least one bag having a loop handle, the carrier comprising:

a shaft for supporting the loop handle when the handle is disposed about said shaft, said shaft having a helical groove formed thereon for providing a frictional surface;

two handle members disposed on and co-axial with said shaft, each handle member being disposed on an opposite end of said shaft, and said handle members being spaced apart from one another on the shaft, said handle members being formed from a compressible resilient material; and wherein the frictional surface of the shaft inhibits rotation of each handle member about said shaft.

2. The bag carrier of claim 1 wherein said handle members are made from plastic foam.

3. The bag carrier of claim 1 wherein said shaft member is made of a material selected from the group consisting of wood, plastic and metal.

4. The bag carrier of claim 1 wherein said shaft is substantially cylindrical in shape.

5. The bag carrier of claim 1 further including a coating disposed on said handle members.

6. The bag carrier of claim 1 wherein the helical groove is formed on at least a portion of the shaft.

7. A bag carrier for transporting a bag having a loop handle, the carrier comprising:

a shaft member for supporting the loop handle of the bag when the handle is disposed about said shaft member, said shaft member being substantially cylindrical in shape and having an outer diameter;

two handle members disposed about and on opposite ends of said shaft member, said handle members being made from a compressible material, the handle members having an inner diameter which is dimensionally less than the outer diameter of the shaft member, the inner diameter of the handle members being located about the outer diameter of the shaft member for securely and frictionally attaching the handle members onto the shaft member; and a helical groove formed on the shaft member between the shaft member and the two handle members.

8. The bag carrier of claim 7 wherein the compressible material is a plastic foam.

9. The bag carrier of claim 7 further including a coating disposed on at least a portion of said handle members.

10. The bag carrier of claim 7 wherein the shaft member is made of a material selected from the group consisting of wood, plastic and metal.

11. A bag carrier for transporting a bag having a loop handle, the carrier comprising:

a wooden shaft member for supporting the loop handle of the bag when the handle is disposed about the shaft member, the shaft member being substantially cylindrical in shape and having an outer diameter;

a handle member slidably disposed about the shaft member, the handle member being substantially cylindrical in shape and being made from a compressible foam material, the handle member having an inner diameter which is dimensionally less than the outer diameter of the shaft member, the inner diameter of the handle member being located about the outer diameter of the shaft member for securely and frictionally attaching the handle member onto the shaft member; and a helical groove formed around the shaft member the groove inhibiting rotation of the handle member about the shaft member.

12. The bag carrier of claim 11 wherein the groove forms a helix around the shaft member.

* * * * *